US007174813B2

(12) United States Patent
Davidson

(10) Patent No.: US 7,174,813 B2
(45) Date of Patent: Feb. 13, 2007

(54) ADJUSTABLE WRENCH

(76) Inventor: Johnnie Fred Davidson, 6941 Nine Mile Bridge Rd., Fort Worth, TX (US) 76135-9261

( * ) Notice: Subject to any disclaimer, the term of this patent is extended or adjusted under 35 U.S.C. 154(b) by 0 days.

(21) Appl. No.: 11/401,496

(22) Filed: Apr. 11, 2006

(65) Prior Publication Data

US 2006/0254395 A1 Nov. 16, 2006

Related U.S. Application Data

(60) Provisional application No. 60/670,980, filed on Apr. 13, 2005.

(51) Int. Cl.
*B25B 13/16* (2006.01)
*B25B 13/12* (2006.01)

(52) U.S. Cl. ..... 81/155; 81/127; 81/129; 81/157; 81/158

(58) Field of Classification Search ..... 81/127, 81/129, 155, 157, 158
See application file for complete search history.

(56) References Cited

U.S. PATENT DOCUMENTS 4,833,949 A * 5/1989 Piperkovski ..... 81/127
6,205,892 B1 * 3/2001 Davidson ..... 81/128
7,096,767 B2 * 8/2006 Sherburne ..... 81/145

* cited by examiner

*Primary Examiner*—Joseph J. Hail, III
*Assistant Examiner*—Shantese McDonald
(74) *Attorney, Agent, or Firm*—Charles D. Gunter, Jr.

(57) ABSTRACT

The invention is an adjustable wrench comprising a handle with a terminal end and grip end, the terminal end defining a lower bolt claw. A jackscrew is slidably coupled to the handle, the jackscrew being movable to control the movement of the upper and central bolt claws. The upper, central, and lower bolt claws are fitted to the shape of a standard hexagonal bolt head, being adjustable to different sized bolts upon terminal or distal movement of the jackscrew relative to the handle. The central bolt claw is fitted through a slot in the upper bolt claw which defines an inclined ramp surface such that movement of one claw is coupled to movement of the other claw. The claws move cooperatively in reaction to the stationary, lower bolt claw to form a tightly fitted surface for a bolt head.

14 Claims, 3 Drawing Sheets

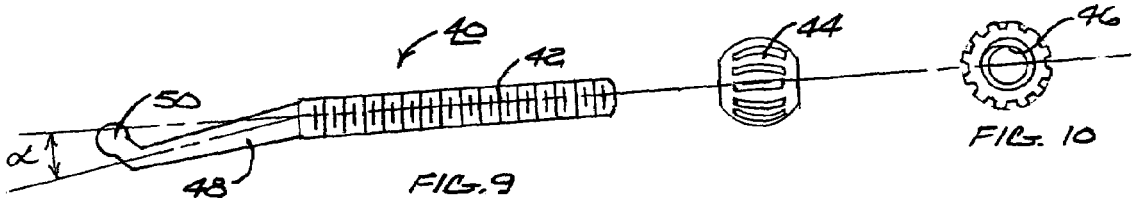
FIG. 9
FIG. 10
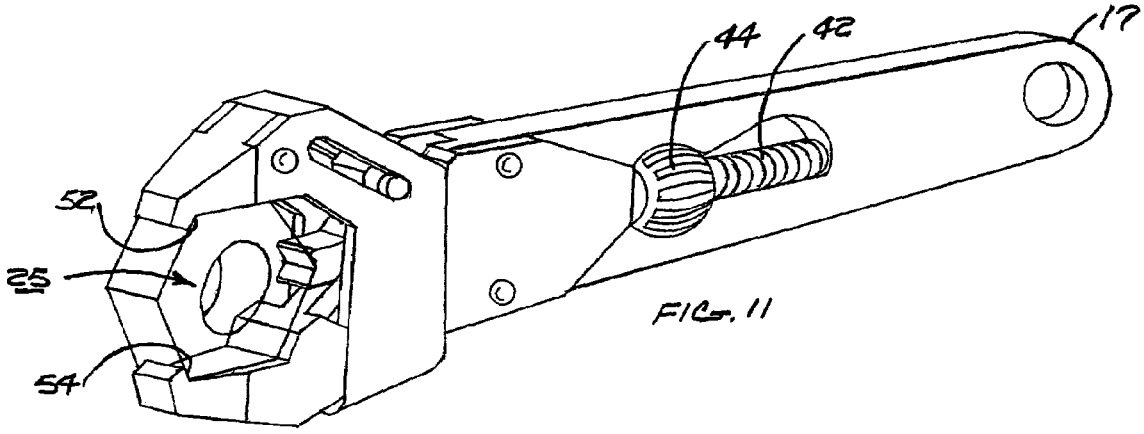
FIG. 11
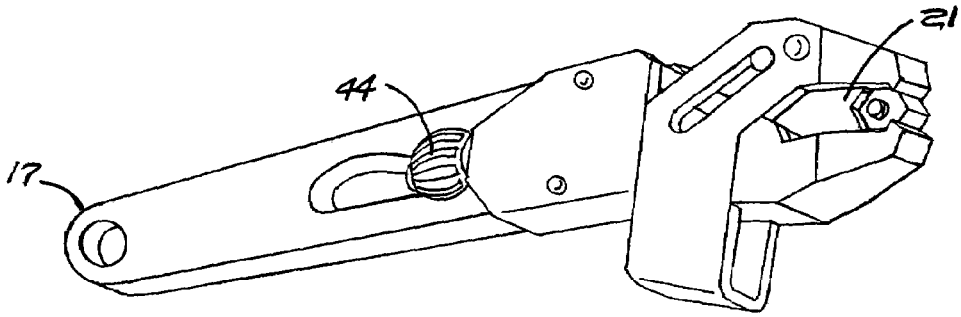
FIG. 12

ADJUSTABLE WRENCH

CROSS REFERENCE TO RELATED APPLICATIONS

The present application claims priority from the previously filed provisional application Ser. No. 60/670,980, filed Apr. 13, 2005, by Johnnie F. Davidson, entitled "Adjustable Wrench."

BACKGROUND OF THE INVENTION

1. Field of the Invention

The present invention relates in general to an adjustable bolt wrench and, in particular, to an adjustable, three-jawed wrench which can be adjusted for any size hexagonal bolt.

2. Description of the Prior Art

Bolt wrenches are an old art. There are primarily three general types of wrenches: socket wrenches, fixed end wrenches, and adjustable wrenches. In each type of wrench, there are several common ideal features. The wrench should be easy to use, since one-handed applications may be necessary in practice. Second, the head of the wrench, the section of the wrench that actually grips a bolt, must be able to grip the bolt in such a way that the corners of the standard hexagonal bolts are not stripped. Once stripped, the bolts become very difficult if not impossible to work with, and must be mechanically cut and replaced. The wrench should be simple in design and economical to manufacture.

Of the three basic types of wrenches in current use, adjustable wrenches offer the most versatility. Further, adjustable wrenches are easier to use than socket or fixed end wrenches, both of which require the user to either replace the socket for different applications or change out the entire wrench. This is time consuming and tedious in many working conditions. An adjustable wrench allows the user to adjust a single tool unit to the various shapes and sizes of bolts, both metric and standard.

The only drawback to adjustable wrenches is their gripping ability. Specifically, adjustable wrenches currently available are not able to fit a bolt as snugly as socket of fixed end wrenches. This often leads to stripping of the bolt head, which further complicates the loosening or tightening of a bolt. Generally, the advantage that socket and fixed end wrenches have in this regard is an increased contact area with the bolt head. Socket and fixed end wrenches are typically designed to contact each of the six corners of the bolt head as well as each side. The greater the contact area, the tighter the fit between the wrench and bolt. Thus, what is needed is a wrench that has the versatility of an adjustable wrench, but also the advantages of fixed and socket wrenches.

Most adjustable wrenches have two bolt claws that are adjustable relative to each other to contact the bolt head, typically on two opposing sides of the hexagonal bolt. Increasing the number of sides contacted, and the number of corners contacted would be ideal. This could be accomplished by increasing the number of bolt claws on the adjustable wrench, thus increasing the surface area of the bolt head contacted. There are pliers in the art that have such a feature. For instance, the Stallings (U.S. Pat. Nos. 1,250,690 and 1,498,488) inventions are pliers with two opposing claws, with a third pivotally mounted claw located central to the other two. The claw contact region is a complex structure, and the use of these pliers is directed towards general gripping of rounded surfaces such as pipes. These devices would not be suitable for a bolt wrench.

There are several other inventions directed towards an adjustable wrench. The Whelan (U.S. Pat. No. 1,401,931) invention is an adjustable pipe wrench that uses two opposing complex surfaced claws for gripping a pipe, with a third attachment coupled in such a manner to allow both parts to slide and pivot, increasing the contact surface area of the pipe being gripped. The Wei (U.S. Pat. No. 5,542,319) invention is an adjustable bolt wrench using two opposing bolt claws with a ratcheted handle. Although an improvement on the prior art, these two devices are either not directed towards a bolt wrench, or do not incorporate the advantages of fixed end wrenches by increasing the contact area of the bolt head and wrench. Thus, there is a need for a wrench that incorporates the ease of use of an adjustable wrench with the advantages of fixed end and socket wrenches.

U.S. Pat. No. 6,205,892, issued Mar. 27, 2001, to the present inventor was an improvement in providing a wrench with increased surface contact between the wrench head and the bolt being gripped. The present invention is directed toward further improvements in that basic design.

SUMMARY OF THE INVENTION

An adjustable wrench is shown which includes a handle with a terminal end and a grip end. The terminal end defines a lower bolt claw. A jackscrew is coupled to the handle. A central bolt claw is coupled to the jackscrew. An upper bolt claw is coupled to the central bolt claw and to the handle for simultaneous movement therewith. The upper, central and lower bolt claws define a fitted opening which forms a portion of the shape of a standard hexagonal bolt head. The fitted opening is adjustable to fit different sized bolt heads upon movement of the jackscrew relative to the handle. The fitted opening defined by the upper, central and lower bolt claws encircles two sides and three corners of the hexagonal bolt head being received therein and partially encircles four remaining sides of the bolt head.

Preferably, the jackscrew is slidably coupled to the handle. The central bolt claw is operably connected to the jackscrew and includes a slidable connection to the upper bolt claw. The central bolt claw moves on an axis which intersects an opening formed between the upper bolt claw and the lower bolt claw. The jackscrew is movable between a distal position and a terminal position with respect to the handle. The central bolt claw is fitted through a groove in the lower bolt claw which defines an inclined ramp surface.

Additional objects, features and advantages will be apparent in the written description which follows.

BRIEF DESCRIPTION OF THE DRAWINGS

FIG. 9 is an exploded view of another version of the jackscrew of the wrench of the invention, showing a ball knob removed from the threaded surface of the jackscrew.

FIG. 10 is an end view of the threaded ball knob of FIG. 9.

FIG. 11 is a perspective view of the second version of the wrench with the jackscrew of FIG. 9 in place.

FIG. 12 is a perspective view, similar to FIG. 11, but showing the jaws of the wrench tightened about a nut.

DETAILED DESCRIPTION OF THE INVENTION

Figure 1:
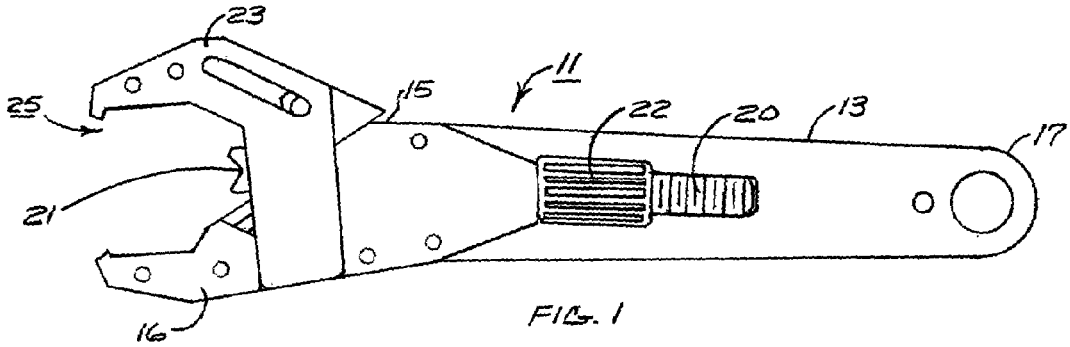
FIG. 1 is a side, perspective view of the improved adjustable wrench of the invention with the jaws thereof in a relatively wide open position.
Figure 2:
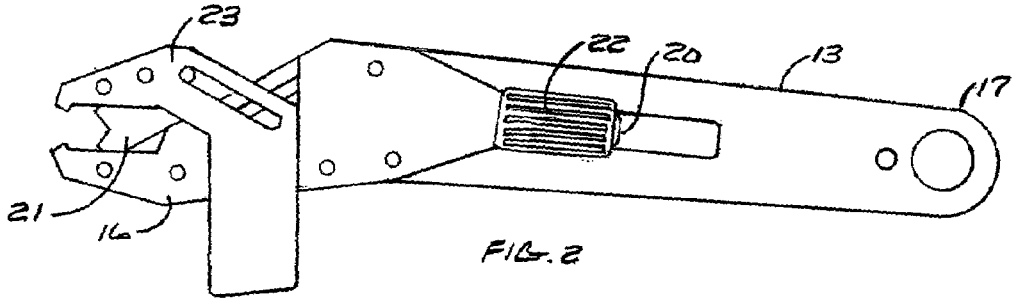
FIG. 2 is a perspective view, similar to FIG. 1, showing the jaws of the wrench being moved toward the fully closed position.

Turning to FIGS. 1–2, there is shown one version of an adjustable wrench 11 of the invention. With reference to FIG. 1, the wrench 11 includes a handle 13 with a terminal end 15 and a grip end 17. The terminal end 15 defines a lower bolt claw 16.

A jackscrew 20 is coupled to the handle and is movable with respect thereto by means of a threaded external surface on which is located a nut 22. A central bolt claw 21 is coupled to the jackscrew 20 and an upper bolt claw 23 is coupled to the central bolt claw 21 and to the handle for simultaneous movement therewith.

The upper, central, and lower bolt claws define a fitted opening (generally at 25 in FIG. 1) which forms a portion of the shape of a standard hexagonal bolt head (shown as 27 in FIG. 6), the fitted opening being adjustable to fit different sized bolt heads upon movement of the jackscrew relative to the handle.

Figure 5:
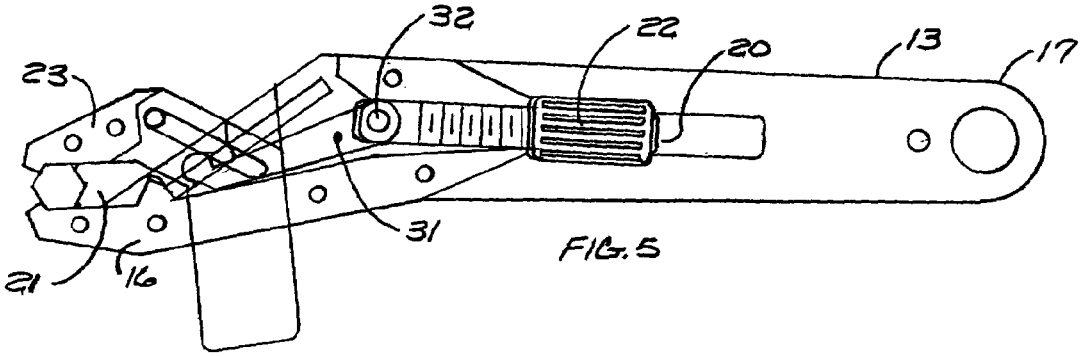
FIG. 5 is a side view of the wrench of FIG. 2 with portions broken away to illustrate the internal workings thereof.
Figure 6:
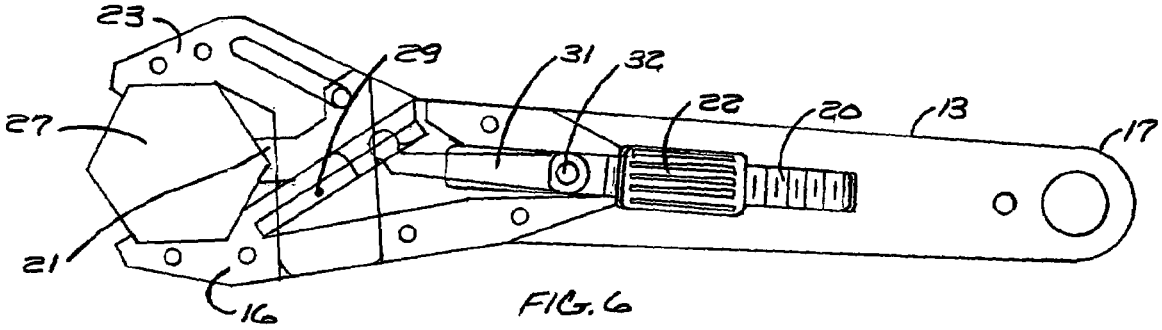
FIG. 6 is a view similar to FIG. 5, but showing the jaws of the wrench gripping a relatively larger sized nut.
Figure 7:
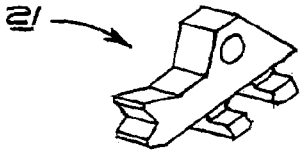
FIG. 7 is an isolated view of the central bolt claw of the wrench of the invention.
Figure 8:
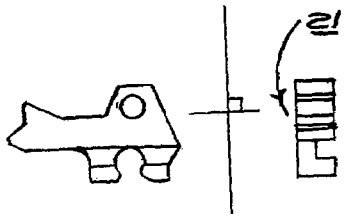
FIG. 8 is a top view of the bolt claw of FIG. 7.

The fitted opening 25 defined by the upper, central and lower bolt claws encircles two sides and three corners of the hexagonal bolt head 27 being received therein and partially encircles four remaining sides of the bolt head in use (see FIGS. 5 and 6).

As shown in FIGS. 5 and 6, the jackscrew 20 is slidably coupled to the handle 13. Turning the nut 22 causes the jackscrew to travel along a longitudinal axis generally parallel to the axis of the handle 13. The central bolt claw 21 is operably connected to the jackscrew 19 and includes a slidable connection to the upper bolt claw. The central bolt claw 21 moves on an axis which intersects an opening formed between the upper bolt claw and the lower bolt claw. As viewed in FIG. 6, the central bolt claw 21 rides in the slot 29. In one version of the tool, the central bolt claw is acted upon by an internal push link (31 in FIGS. 5 and 6) which is, in turn, connected to an outer extent of the shaft of the jackscrew 20 at a pivot point 32.

FIGS. 9–12 show another version of the wrench of the invention in which the push link and jackscrew have been combined into a single driver element 40. The driver element 40 again has an externally threaded surface 42 for matingly engaging a ball knob 44. The ball knob has an internally threaded bore 46. Turning the ball knob causes the driver element 40 to travel longitudinally in the bore 46. The driver element 40 has an outer extent 48 which has a downward cant, extending downwardly at an angle "$\alpha$" of approximately 12° with respect to the opposite extent of the element. The outermost extent 50 of the driver element 40 forms a rounded protuberance which cooperates with the central bolt claw 21, whereby turning the ball knob 44 causes the driver element 40 to move the central bolt claw 21 inwardly and outwardly with respect to the fitted opening 25 of the wrench.

Figure 3:
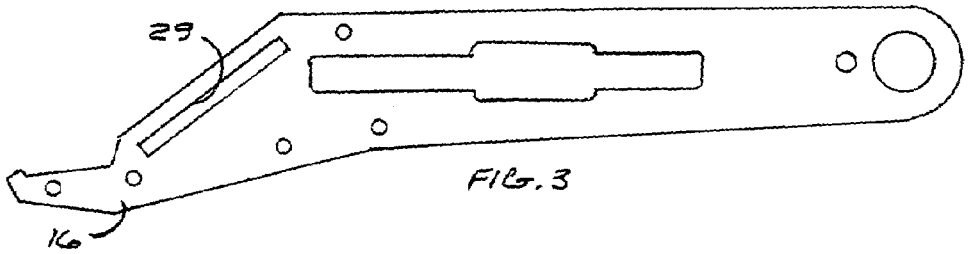
FIG. 3 is an isolated side view of one of the handles of the wrench of the invention.
Figure 4:
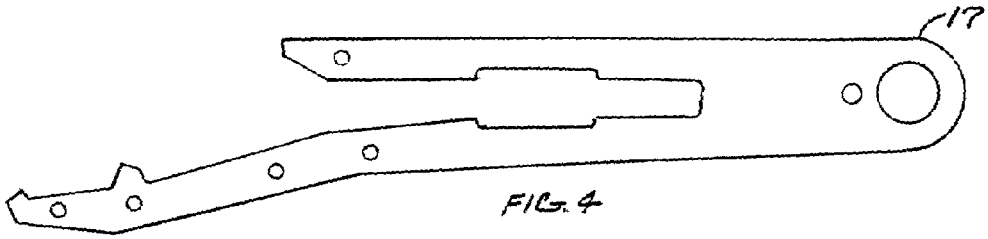
FIG. 4 is an isolated side view of another of the handles of the wrench of the invention.

In both versions of the wrench, the jackscrew 20 or driver element 40 is movable between a distal position and a terminal position with respect to the handle in order to determine the position of the central bolt claw 21 within the fitted opening 25 of the wrench. FIGS. 3 and 6 further illustrate the slot or groove 29 in which the central bolt claw 21 is preferably fitted. The slot or groove provided in the lower bolt claw (16 in FIG. 3) defines an inclined ramp surface. The fitted opening of the wrench, illustrated as 25 in FIG. 1, thus forms a portion of the shape of a standard hexagonal bolt head, the fitted opening being adjustable to fit different sized bolt heads upon movement of the jackscrew 20 or driver element 40 between distal and terminal positions relative to the handle (as illustrated in FIGS. 5–6 and 11–12). The upper and lower bolt claws have terminal outer extents (52 and 54 in FIGS. 11 and 12) which are specifically fitted for gripping two sides and three corners of bolt being gripped.

An invention has been provided with several advantages. The improved wrench of the invention has claws which move cooperatively in reaction to the stationary, lower bolt claw to form a tightly fitted surface for a bolt head. A simple jackscrew mechanism is manually adjusted during adjustment of the wrench to fit a variety of sizes of bolt heads. The improved design enables reduction of manufacturing costs, improved location of certain components, and the jackscrew feature enhances use and operation. While the handle/lower jaw of the wrench may be provided as a one piece hardened forging, it is also possible that a majority of the component parts of the wrench may be constructed of laminations, providing a wrench capable of exerting the necessary torque. The construction of the wrench also lends itself to automated and relatively inexpensive production.

While the invention has been shown in only two of its forms, it is not thus limited but is susceptible to various changes and modifications without departing from the spirit thereof.

What is claimed is:

1. An adjustable wrench comprising:

a handle with a terminal end and a grip end, the terminal end defining a lower bolt claw;

a jackscrew coupled to the handle;

a central bolt claw coupled to the jackscrew;

an upper bolt claw coupled to the central bolt claw and to the handle for simultaneous movement therewith;

the upper, central, and lower bolt claws defining a fitted opening which forms a portion of the shape of a standard hexagonal bolt head, the fitted opening being adjustable to fit different sized bolt heads upon movement of the jackscrew relative to the handle; and wherein the fitted opening defined by the upper, central and lower bolt claws encircles two sides and three corners of the hexagonal bolt head being received therein and partially encircles four remaining sides of the bolt head.

2. The adjustable wrench of claim 1, wherein the jackscrew is slidably coupled to the handle.

3. The adjustable wrench of claim 1, wherein the central bolt claw is operably connected to the jackscrew and includes a slidable connection to the upper bolt claw.

4. The adjustable wrench of claim 1, wherein the central bolt claw moves on an axis which intersects an opening formed between the upper bolt claw and the lower bolt claw.

5. The adjustable wrench of claim 1, wherein the jackscrew is movable between a distal position and a terminal position with respect to the handle, movement of the jackscrew serving to move the central bolt claw inwardly and outwardly, respectively, with respect to the fitted opening defined by the upper, central and lower bolt claws.

6. The adjustable wrench of claim 1, wherein the central bolt claw is fitted through a groove provided in the lower bolt claw defining an inclined ramp surface.

7. An adjustable wrench comprising:

a handle with a terminal end and a grip end, the terminal end defining a lower bolt claw;

a jackscrew coupled to the handle for sliding movement relative to the handle;

a central bolt claw coupled to the jackscrew; upper bolt claw coupled to the central bolt claw and to the handle; and the upper, central, and lower bolt claws defining a fitted opening which forms a portion of the shape of a standard hexagonal bolt head, the fitted opening being adjustable to fit different sized bolt heads upon movement of the jackscrew between distal and terminal position relative to the handle.

8. The adjustable wrench of claim 7, wherein the central bolt claw is fitted through a slot in the lower bolt claw defining an inclined ramp surface.

9. The adjustable wrench of claim 7, wherein the jackscrew is located within a cavity provided in the wrench handle.

10. The adjustable wrench of claim 9, wherein the terminal end of the jackscrew is operatively associated with the central bolt claw.

11. The adjustable wrench of claim 10, wherein the upper, lower, and central bolt claws are fitted to the a bolt head by movement of the jackscrew terminal end towards the handle terminal end.

12. The adjustable wrench of claim 11, wherein the terminal end of the jackscrew is pivotally connected to a push link, the push link having a first end and a second end, and wherein the central bolt claw is operatively associated with the second end of the push link.

13. The adjustable wrench of claim 12, wherein the push link and jackscrew are combined into a single driver element.

14. The adjustable wrench of claim 13, wherein the upper and lower bolt claws have terminal outer extents which are specifically fitted for gripping two sides and three corners of bolt being gripped.

* * * * *